United States Patent [19]

Sarkar et al.

[11] 4,146,135

[45] Mar. 27, 1979

[54] SPOT DEFECT DETECTION APPARATUS AND METHOD

[75] Inventors: Subhash C. Sarkar, Sunnyvale; Donald W. Chamberlin, Los Gatos, both of Calif.

[73] Assignee: FMC Corporation, San Jose, Calif.

[21] Appl. No.: 841,093

[22] Filed: Oct. 11, 1977

[51] Int. Cl.[2] ..... B07C 5/342

[52] U.S. Cl. ..... 209/580; 209/546; 209/565; 209/577; 209/586; 250/226; 356/407; 356/448

[58] Field of Search ..... 209/73, 74 R, 74 M, 209/111.5, 111.6, 111.7 R, 111.7 T; 250/226, 560; 356/173, 178

[56] References Cited

U.S. PATENT DOCUMENTS

| | | | |
|---|---|---|---|
| 2,823,800 | 2/1958 | Bliss | 209/111.6 |
| 2,933,613 | 4/1960 | Powers | 209/111.6 X |
| 3,005,550 | 10/1961 | Flanders et al. | 209/111.6 |
| 3,467,254 | 9/1969 | Simmons | 209/111.6 |
| 3,628,657 | 12/1971 | Billett | 209/111.7 T |
| 3,910,701 | 10/1975 | Henderson et al. | 356/173 X |

*Primary Examiner*—Joseph J. Rolla

*Attorney, Agent, or Firm*—R. S. Kelly; H. M. Stanley

[57] ABSTRACT

An on-line detector for peach pits and peach pit fragments and the like remaining in peach halves following a pitting operation includes a sealed housing bordered on one side by an inclined view plate disposed between a feeding belt and a take-away belt. A peach half, pit cavity down, is passed by a viewing line above the view plate. Two different wavelengths of light are directed toward the viewing line and are reflected by a passing fruit section toward an array of light sensors. One of the wavelengths of light is controlled in on-off condition by a clock, being turned on during only a portion of each clock cycle. Output from each one in the array of light sensors is sampled during the portion of each clock cycle that the one wavelength is on, and differenced with the light sensor output from that sensor when the other wavelength only is on. Differencing occurs during each clock cycle and a difference output appears only in the presence of a pit or a pit fragment. Difference signals are summed to provide an indication of the size of a detected pit or pit fragment, and the summation is used to control accept/reject mechanism on-line downstream of the viewing line.

24 Claims, 9 Drawing Figures

SPOT DEFECT DETECTION APPARATUS AND METHOD

BACKGROUND OF THE INVENTION

1. Field of the Invention

The present invention relates generally to improved means and techniques for detecting the presence of spot defects such as areas of discoloration, pits or seeds or fragments thereof in fruit, and, more particularly, to improved means and techniques for detecting the presence of such an area anywhere on a fruit, or a peach pit or pit fragments in the pit cavity of a peach half, and for classifying the fruits or peach halves according to the presence, size or number of discolored areas or pit fragments detected.

2. Description of the Prior Art

In the processing of peaches in peach canneries, the peaches are usually cut in half by a saw or knife, and the peach pit is removed by a pitter. Following this, the outer skin of the peach is removed and each of the halves is then delivered to an inspection station for detection of blemishes, discoloration, pits, and pit fragments prior to canning. The operation of the peach pitter, while generally satisfactory, is not perfect, and as a result many of the peach halves still retain a pit or a fragment of a pit. Peach halves which contain pits or pit fragments are undesirable due to the potential injury posed to a consumer's teeth. Consequently, it is important to provide an inspection means for assuring that no peach halves are canned which contain any pit or pit fragments.

In the past, the inspection of peach halves was accomplished by means of visual observation and manual removal. This technique, in order to be reasonably satisfactory, necessitated the employment of many inspectors at considerable expense. A further problem associated with the use of people as inspectors is that the inspectors are prone to fatigue, especially when engaged in repetitive inspection activity. Consequently, some of the peaches containing pit fragments will not be removed from the batch of peach halves and will be canned. Due to the aforementioned factors, a sampling inspection routine is frequently used wherein less then all of the peach halves are inspected.

Another prior art technique used in the detection of peach pits and pit fragments in peach halves involves illuminating the peach half cavity and measuring the amount of light transmitted therethrough. Basically, this method involves the use of transmitted light to effect a contrast between a peach half free of fragments and a peach half having a pit fragment within the area scanned by a slit placed between a photocell and the peach half. Such a system is described in U.S. Pat. No. 3,005,549, Flanders et al, entitled "Peach Pit Fragmentation Detection Means and Techniques". However, as pointed out in this patent, one of the significant limitations imposed by the use of this particular method is that the size of pit fragment detectable is limited to a fragment no smaller than about one-eighth the size of the whole pit. Further, it should be noted that the operation of this particular device as disclosed by Flanders et al is dependent on the particular position of a pit fragment. The reason given in the patent for this position sensitivity is that only a portion of the average diameter of the pit cavity is scanned. Therefore, it is quite possible that a peach pit fragment may go undetected in the cavity when using the Flanders et al apparatus, and, as a result, the peach half containing a pit or pit fragment will not be culled, i.e., discharged as unacceptable. The degree of detector resolution and cavity inspection discussed above is unacceptable by present standards, because a peach pit fragment of a size smaller than about one-eighth the size of the whole pit can cause severe injury to a consumer's teeth, thereby incurring legal liability for the canner.

Another prior art patent, U.S. Pat. No. 2,823,800, Bliss, is of interest in the discussion of the subject matter of the instant invention. The Bliss patent relates to an egg inspection machine, generally referred to as an "automatic candler". Such a machine non-destructively inspects eggs to cull those eggs containing spots of blood therein. The Bliss machine teaches the use of two different strobed light sources transmitting relatively narrow bands of light wavelengths to illuminate the egg to be inspected. One of the light wavelength bands is selected so that the amount of light transmitted through the egg is relatively unaffected by the presence or absence of blood in the egg. The other of the light wavelength bands is selected because its transmission through the egg is substantially affected by the presence of blood in the egg. The amount of light transmitted through the egg in the two different bands is alternately sensed by a phototube. The phototube output is fed to the control grids of a pair of triodes arranged in a circuit to function as a differentially balanced amplifier. When an egg containing blood is observed, the amplifier circuit becomes unbalanced, allowing current to flow through a relay coil. The relay operates to close a switch, energizing a solenoid-operated discharge paddle which discharges the egg. This circuit arrangement requires that the circuit be periodically balanced to assure proper operation. A further limitation of the Bliss system lies in the fact that it does not provide any means for adjusting the resolution of the machine so that it can detect very small blood spots. Another restrictive characteristic inherent in this device is the necessity for the inspected item to be translucent so that light may be transmitted through the object. Additionally, a variation in transparency and/or density in the inspected item requires adjustment in the intensity of the light source to assure that sufficient light is transmitted through the inspected item for adequate sensitivity.

It may be seen that a discoloration area, pit or pit fragment detector is required which has sufficiently fine resolution to detect smaller discolored areas or pit fragments, and which is continuously on-line to thereby provide inspection for 100% of the fruit or fruit sections passing there-along.

SUMMARY OF THE INVENTION

In general the disclosed detector for discoloration areas in fruit or for fruit pits and fruit pit fragments which remain in a section of fruit which is passed by a viewing line on a processing path, includes a first and a second light source providing different light wavelength outputs which are directed toward the viewing line. The small areas to be detected have a different reflectance than that of the remaining portions of the fruit at one of the light source outputs. A clock provides a clock signal in a continuous sequence of clock cycles. Light source drivers are provided which energize each of the light sources during each clock cycle. The first light source is energized for only a portion of each clock cycle. An array of light sensors is disposed to receive light from the first and second light sources which is reflected from the fruit along the viewing line and points proximate thereto. Each of the light sensors in the array provides a light sensor output which corresponds to the intensity of the reflected light impinging thereon. Means is provided for scanning the light sensor outputs so that each output is made available in sequence during successive clock cycles. Means is provided for sampling each light sensor output during that portion of each clock cycle when the first light source is energized. The sampled output is retained throughout the remainder of that clock cycle and is connected to one input of a differencing device. Another input on the differencing device is connected to receive directly the scanned output during the remainder of the clock cycle. A difference signal is thereby provided which corresponds to the difference between the sampled output when the first light source is energized and the light sensor output when the first light source is deenergized. Therefore, a difference signal is provided during each clock cycle which has a level indicative of the presence or absence of a defect (such as a pit or a pit fragment) along the viewing line.

The method for detecting the presence of discoloration areas or defects such as a pit or pit fragment in a pitted fruit section which is transported on a path past a viewing line includes the steps of directing two separate light spectrum wavelengths toward the viewing line. One of the wavelengths is more readily reflected by the defect areas than the other. The more readily reflected wavelength is cycled on and off at a predetermined frequency so that it is transmitted for only a portion of each frequency cycle. The reflections of the two wavelengths from the viewing line are sensed, and an output is provided which corresponds to the received reflected wavelengths. The sensed output is sampled during the portion of each frequency cycle that the more readily reflected wavelength is produced and is held for the remainder of the cycle. The sampled and held output is differenced with the sensed output during each cycle when the more readily reflected wavelength is not produced and the other wavelength is produced. Summing of those differences which exceeds a predetermined difference is accomplished over a series of cycles as the fruit is viewed, such sum indicating the size of the defect area in the passing fruit.

It is an object of the present invention to provide a spot defect, discoloration area or pit fragment detector which provides fine sesolution for detection of small defects.

It is another object of the present invention to provide a spot defect, discoloration area or pit fragment detector for use as on-line equipment to inspect 100% of the fruit or fruit sections being transported on the processing line.

It is another object of the present invention to provide a spot defect, discoloration area or pit fragment detector and method which allows finer classification of passing fruit or fruit sections.

Additional objects and features of the invention will appear from the following description in which the preferred embodiments have been set forth in detail in conjunction with the drawings.

DESCRIPTION OF THE PREFERRED EMBODIMENTS

Figure 1:
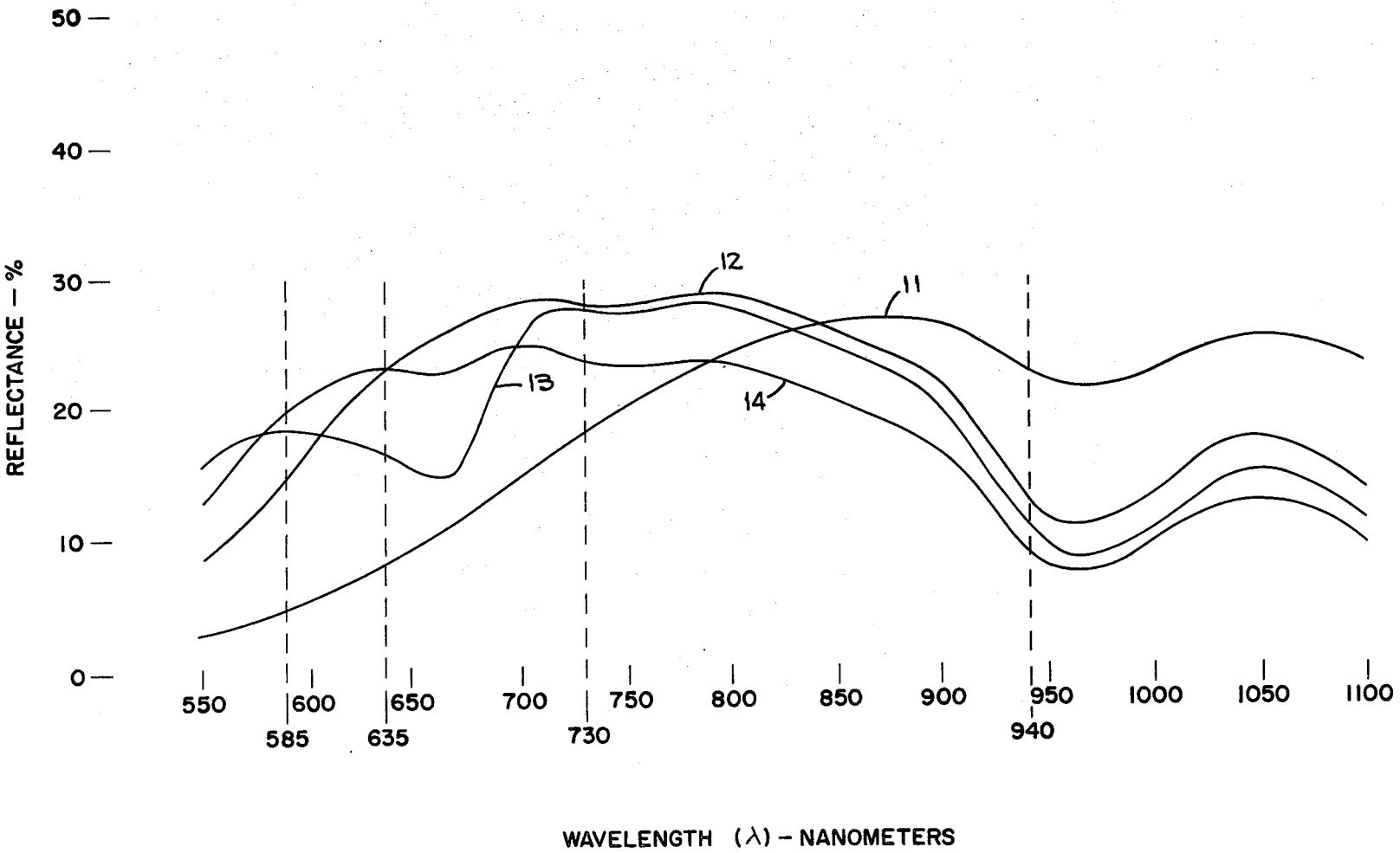
FIG. 1 is a set of spectro-photometer curves showing percent reflection as a function of light wavelength for pit and fruit samples.

The word "light " as used herein refers to that portion of the electro-magnetic spectrum including the ultraviolet and infrared and that portion therebetween. FIG. 1 is a spectrophotometer scan of that portion of the light spectrum from a wavelength of about 550 nanometers to approximately 1,100 nanometers. Reflectance in percent is shown as a function of light wavelength for four samples scanned. The relationship between the percent reflectance and light wavelengths for a peach pit or pit fragment is shown on a curve 11. Percent reflection as a function of light wavelengths for a peach pit cavity having a reddish hue is shown by curve 12. Percent reflectance as a function of light wavelengths for a peach pit cavity having a greenish hue is shown by curve 13. A curve 14 shows percent reflection as a function of light wavelength for a peach pit cavity having a yellowish hue. A depression in the greenish cavity curve 13 is seen for light wavelengths around 665 nanometers, which is referred to as the "chlorophyll" dip. It may be further seen in FIG. 1 that the reflectance afforded by the pit sample is greater than the reflectance afforded by any of the three different colored fruit samples for wavelengths which are greater than about 850 nanometers. The reflectance of a pit sample is much greater than the reflectance of any of the fruit samples at a wavelength of 940 nanometers, for example, in the infrared region of the light spectrum. Therefore, a measure of reflected light having that wavelength is a good indication of the presence or absence of a pit or pit fragment in a fruit section such as a peach half toward which the 940 nanometer wavelength light is directed. Light directed toward the same fruit section sample which light has a wavelength of about 635 nanometers is reflected by the fruit, but is primarily absorbed by the pit or pit fragment. Reflected light having 635 nanometer wavelength is, however, of lesser intensity for a fruit section having a clean pit cavity with a greenish hue than it is for other fruit sections due to the "chlorophyll" dip. Light having a wavelength of about 585 nanometers, the yellow portion of the visible spectrum, is seen to be almost entirely absorbed by a pit sample. The three different hues of fruit sample, on the other hand, are seen to each reflect between 10 to 20% of light impinging thereon at a 585 nanometer wavelength. Light having a wavelength of about 730 nanometers, the near infrared region, will be seen to be reflected by significantly greater percentages than the light at the shorter wavelengths. Hence, a higher sensor signal is produced by light sensors receiving the light energies.

It should be noted here that articles which are prone to display areas or spots of distinct color characteristic difference with other areas on the articles may, in general, be sorted by the disclosed apparatus in accordance with whether or not such spots or areas are present. For example, imperfections on fruit articles or the like, such as bruises or worm holes may be detected. For purposes of simplification the remainder of this disclosure will deal only with peach pit fragment detection in a peach pit cavity.

Figure 2:
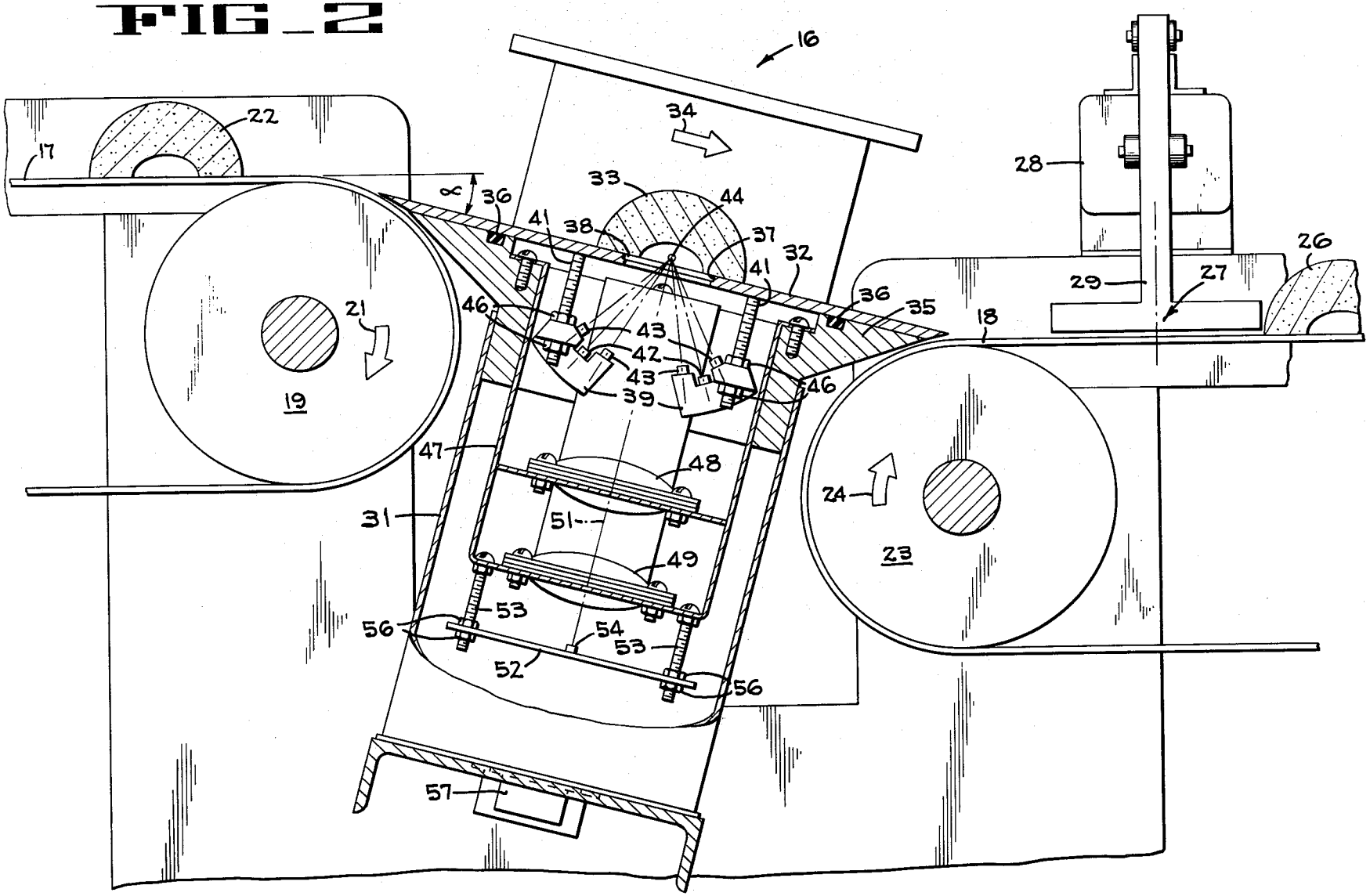
FIG. 2 is a longitudinal section through the pit fragment detector of the present invention.

FIG. 2 shows a peach pit detector assembly 16 mounted in position between and aligned with a feeding belt 17 and a takeaway belt 18. Feeding belt 17 is driven and/or guided by a pulley 19. Rotation of pulley 19 in the directin of arrow 21 is seen to move the upper portion of feeding belt 17 toward peach pit detector assembly 16. A peeled peach half 22 with the peach pit removed therefrom by a previous pitting operation is shown positioned on the upper portion of feeding belt 17 moving toward detector assembly 16.

Takeaway belt 18 is shown being driven or guided by a pulley 23. Then the pulley 23 is rotated in the direction indicated by arrow 24 the upper portion of takeaway belt 18 moves in a direction away from the peach pit detector assembly 16. A pitted peach half 26 is shown on takeaway belt 18 having passed a discharge station 27. A solenoid 28 is shown positioned adjacent to discharge station 27, operating to acuate a paddle 29 which is used to divert cull peach halves containing pits or pit fragments from the processing path on takeaway belt 18.

A housing 31 encloses peach pit detector assembly 16 and includes a viewer plate 32 extending along the upper side thereof. Feeding belt 17 and takeaway belt 18 are disposed at different elevations, so viewer plate 32 is inclined through an angle $\alpha$ extending downwardly from belt 17 to belt 18. A peach half 33 shown on viewer plate 32 is carried in the direction of arrow 34 by the momentum imparted thereto be feeding belt 17. Viewer plate 32 is inclined downwardly through angle $\alpha$ to aid the motion of peach half 33 thereacross by adding a sufficient portion of the effect of gravity to overcome the resistance to motion provided by the friction between peach half 33 and viewer plate 32.

The viewer plate 32 rests atop and is securely attached to a body portion 35 of housig 31 to which it is sealed by means such as O-ring 36 disposed in shallow grooves in the body portion as shown in FIG. 2. Viewer plate 32 has a window 37 in the center thereof in which is disposed a quartz plate 38. Quartz plate 38 is selected so as to have no light filtering effect in the spectrum portions of interest. A pair of light source holders 39 are shown suspended beneath the viewer plate 32 on threaded standoffs 41. A linearly arranged array of light sources 42 (FIG. 3) is mounted on each of the light source holders 39, providing a source of light having substantially a single wavelength within the light spectrum. Another linear array of light sources 43 is mounted on each of the light source holders 39 parallel to the array of light sources 42 and transmitting light at substantially a single wavelength which is different from the wavelength of light transmitted by light source 42. Light source holders 39 are adjustable along threaded standoffs 41 until the four arrays of light sources 42 and 43 are all directed primarily to a viewing line (FIG. 2) located above quartz plate 38 and within the pit cavity of a fruit section which may be sliding over the plate. The two light source holders 39 are locked in place by means such as nuts 46 after being adjusted in position on standoffs 41. A lens holder 47 is mounted within housing 31 by attachment at its upper end to the body portion 35 of the housing. A pair of objective lenses 48 and 49 are mounted in spaced relationship within lens holder 47 in position along a plane 51 extending through the viewing line 44 at right angles to the plane of the viewer plate 32. A light sensor mounting plate 52 is mounted below lens holder 47 on a pair of threaded bolts 53 which extend from the lower end of the lens holder structure. A linear array 54 of light sensors is mounted on light sensor mounting plate 52 along the plane 51. Light sensor mounting plate 52 is adjustable along the threaded bolts 53 to position the array of light sensors at the image plane of the combination of lenses 48 and 49. The light sensor mounting plate 52 is locked in adjusted position on the bolts 53 by means such as nuts 56. Housing 31 has the appropriate electrical connectors 57 mounted in the bottom wall thereof. All apertures through the surfaces of housing 31 are properly sealed as are all joints between adjacent walls. Peach pit detector assembly 16 may therefore be sprayed with a wash solution in order to keep the viewing surface of quartz plate 38 clean without admitting any water to the interior.

Figure 3:
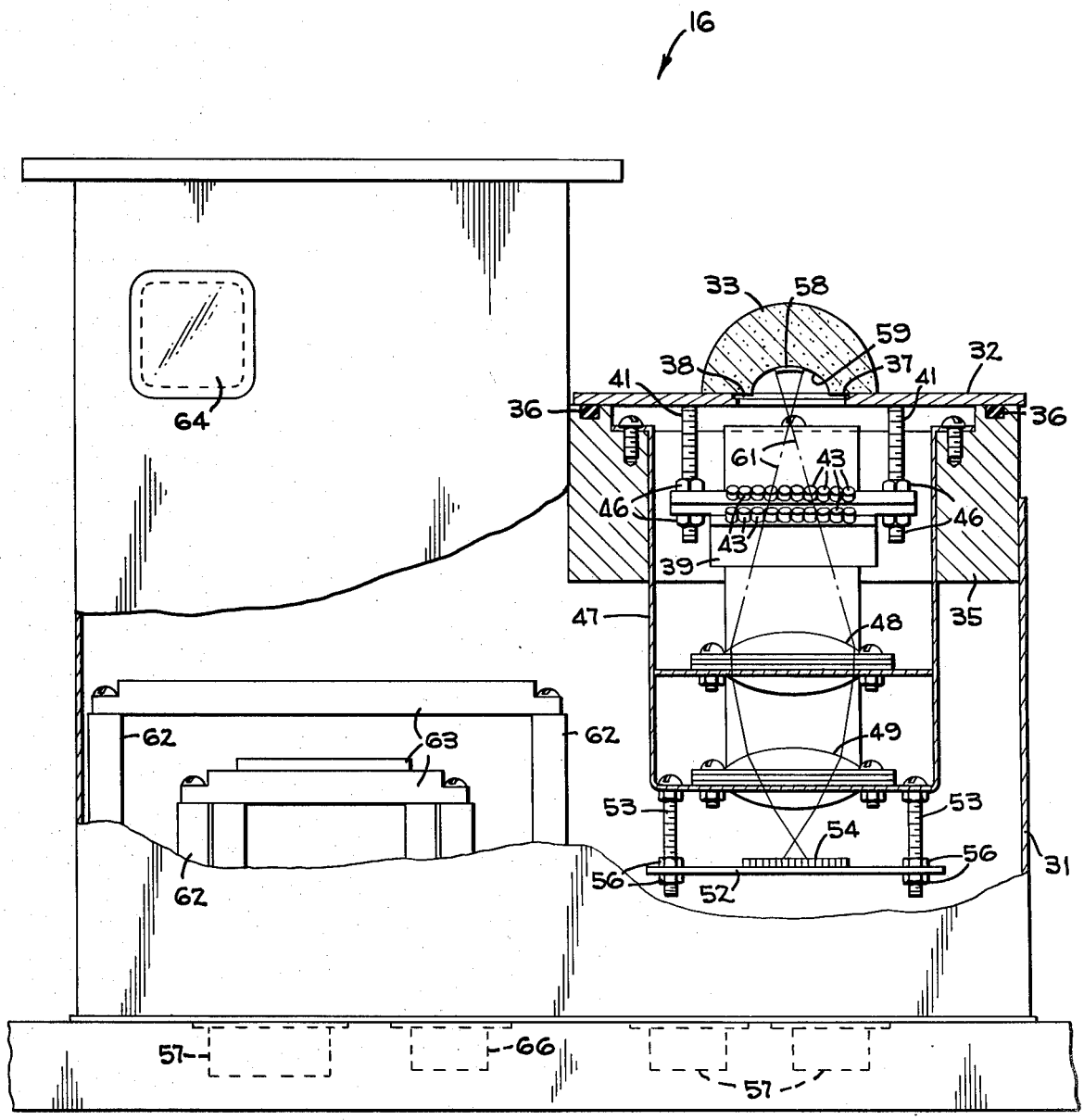
FIG. 3 is a side elevational view, partially in section, of the pit fragment detector of FIG. 2.

FIG. 3 shows peach pit detector assembly 16 with part of the housing 31 cut away to expose two of the arrays of light sources 42 and 43 as well as lenses 48 and 49 and light sensor array 54. Lenses 48 and 49 focus the light reflected from the peach cavity along the viewing line 44 and points proximate thereto into the plane in which light sensor array 54 is positioned by adjustment of light sensor mounting plate 52. As seen in FIG. 3, a peach pit fragment 58 within cavity 59 in peach 33 has light impinging thereon from both light sources 42 and 43. Reflected light is represented by rays 61 which are seen to be focused to provide a reverse image in the plane within which the light sensor array 54 is disposed.

An electronics section is provided within housing 31 containing a number of standoffs 62 on which are mounted various circuit boards 63 which carry the circuitry to be hereinafter described. A sealed window 64 is also provided in housing 31, through which a display indicative of the size of detected peach pit fragments may be read. Housing 31 may contain a desiccant to absorb moisture entering therein, or dry air may be introduced into housing 31 through a covered dry air aperture 66.

Figure 4:
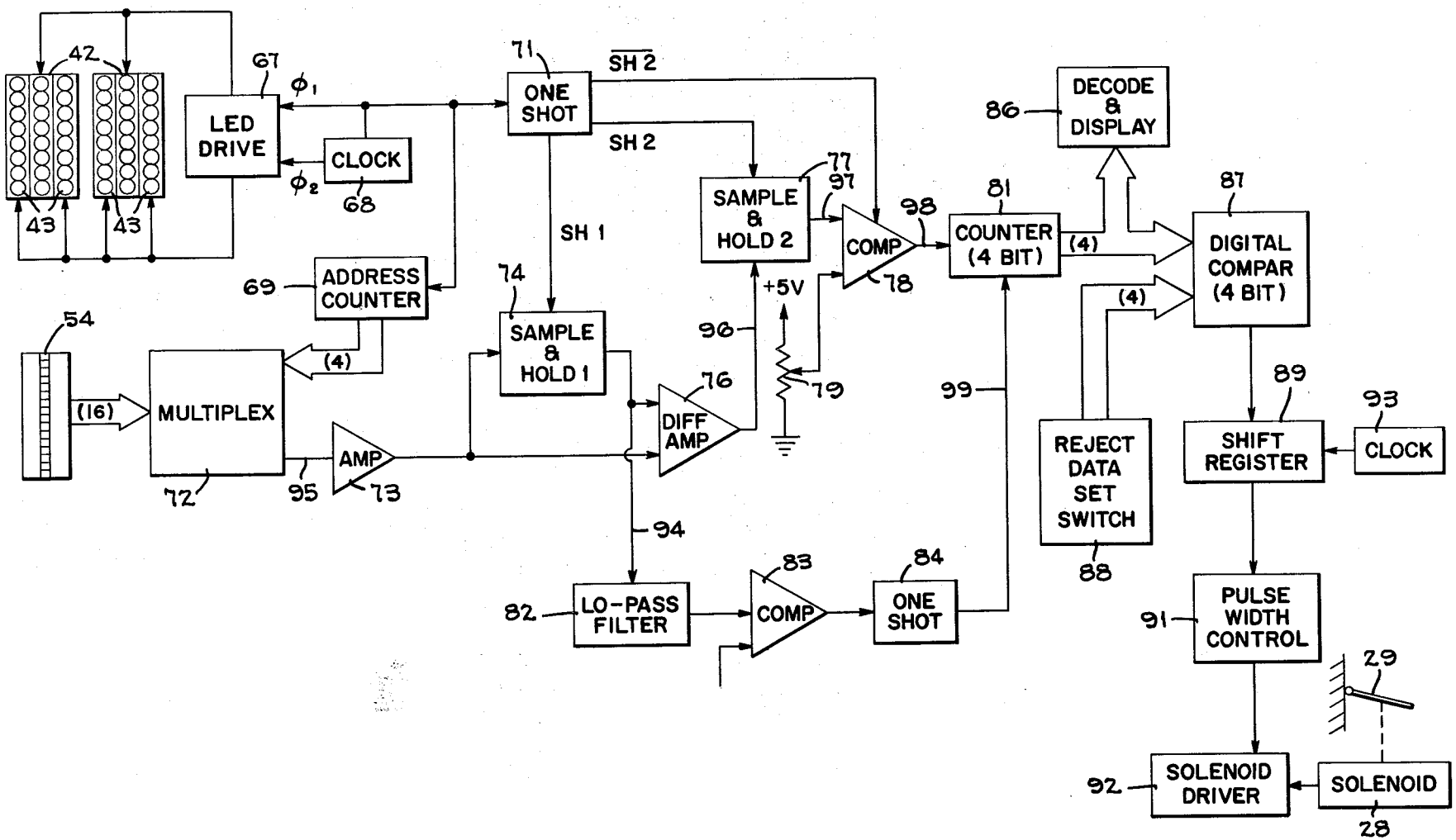
FIG. 4 is a schematic block diagram of the circuitry for the pit fragment detector of the present invention.

Turning now to the block diagram of FIG. 4, light arrays 42 and 43 are shown being energized by an LED drive circuit 67. LED light sources 42 in this embodiment have been selected from those presently commercially available to provide light having a very narrow bandwidth centered on substantially a single wavelength of 940 nanometers. The light sources 43 have been selected from commercially available LED's to provide light having a very narrow bandwidth centered on substantially a single wavelength at either 635 or 585 nanometers. Another choice for light sources 43 would be an LED having a center wavelength of 700 nanometers, such LED's being available and identified by industry designation HEMT 6000. The choice of wavelength for light sources 43 is somewhat dependent upon the application, as will be hereinafter described, but 730 nanometers is presently preferable for peach pit or peach pit fragment detection. If a narrow band LED cannot be obtained with emission at or about this frequency, light sources 43 may be comprised of continuously energized incandescent lamps associated with an appropriate light filter to pass a narrow band of wavelengths centered at 730 nanometers. In the embodiment hereinafter described both light sources 43 and 42 will be described as being alternately turned on and off during each clock cycle.

A stobe signal is provided by a clock 68 which produces a two phase clock signal wherein the two phases are in 180° relation and are produced in a continuous series of clock cycles. The clock signals are connected to LED drive 67 as well as to an address counter 69 and a one-shot circuit 71 as shown. Light sources 42 and 43 are alternately energized by LED drive 67 during each clock cycle provided by clock 68. Light produced by the light sources 42 impinges upon an object such as peach half 33 along viewing line 44, and light at the wavelength of light sources 42 is reflected therefrom toward the light sensor array 54. Thereafter, the light sources 42 are deenergized and the array of light sources 43 is energized. Light at the wavelength of light sources 43 is then reflected from the peach half 33 to the array 54 of light sensors. Therefore, during each clock cycle, light sensor array 54 receives reflected light both at the wavelength of light sources 42 and at the wavelength of light sources 43.

In the disclosed embodiment of the invention the array 54 of light sensors comprises sixteen individual sensors disposed in a line transverse to the direction of travel of a pitted fruit as shown by arrow 34 in FIG. 2. A multiplexer 72 (FIG. 4) receives the outputs from all of the 16 light sensors in array 54. Each of the 16 inputs to multiplexer 72 is addressed in sequence by address counter 69 at the frequency of clock 68 to thereby provide the output from each sensor in array 54 in sequence at the output of multiplexer 72. The serial output of multiplexer 72 is amplified by an amplifier 73, which provides an output coupled to a sample and hold circuit 74 and to a first or negative input of a differential amplifier 76. One-shot circuit 71 produces an output SH1 causing sample and hold circuit 74 to sample the output from the amplifier 73 during the first half of a clock cycle and to provide it at a second or positive input to differential amplifier 76 for the remainder of the clock cycle during which the sample is taken. Differential amplifier 76 produces a difference signal output, which is connected to a second sample and hold circuit 77. Second sample and hold circuit 77 receives a sample command signal SH2 from one-shot circuit 71 and provides an output corresponding to the output of differential amplifier 76 with transients removed. The output from second sample and hold circuit 77 is connected to one input of a comparator 78. Another input to comparator 78 is connected to an adjustable reference level voltage obtained from a trim pot 79. Comparator 78 is enabled once in the later half of each clock cycle by a signal $\overline{SH2}$ from one-shot circuit 71, thereby providing an output pulse when a difference signal occurs at the output of differential amplifier 76 and second sample and hold circuit 77 which is greater than a predetermined difference as set by the trim pot 79. The output pulses from comparator 78 are counted in a digital counter 81 providing a four-bit binary output. The output from sample and hold circuit 74 is directed to a low-pass filter 82 as well as to the second input of differential amplifier 76. When an object is coincident with viewing line 44 to reflect the light produced by the light sources 42 and 43, the output from sample and hold circuit 74 is high for the sensors which receive the reflected light thereby providing an output from low-pass filter 82, which generally represents the integrated sampled signals from the entire array of sensors thereby indicating the presence of a peach over the viewing line 44. The comparator 83 receives the output from low-pass filter 82 providing an enabling signal for digital counter 81 when the signal level from filter 82 reaches a predetermined level with such level being set high enough to prevent ambient light from enabling the counter and to prevent an enabling signal from being generated until a sufficient portion of the peach is seen by the sensor array 54. The enabling signal from comparator 83 is directed to a one-shot circuit 84 which provides an output pulse to set the maximum time of the counter enabling signal, such maximum time being determined by the amount of time required to scan the pit cavity of the largest peach section being viewed. As soon as the enabling signal goes to zero value, the counter 81 will automatically reset itself to zero.

The output from digital counter 81 is provided to a digital decoder and display 86. The display may then be viewed through sealed window 64 as seen in FIG. 3, to determine the size of the pit fragments in any peach which has a pit or pit fragments left therein. The output from digital counter 81 is also delivered to a four-bit input at a digital comparator 87. A second four-bit input to digital comparator 87 is provided by a reject data set switch 88, which may be manually set thumb wheel type switch to indicate a pit fragment or fragments of a predetermined size as, for example, of a size which makes their removal by automatic machinery possible; thus, it is desired to reject these peaches at the discharge station 27 while those peaches which are without pit fragments or with fragments of less than said predetermined size will pass by the discharge station. The latter category may be rejected at a subsequent discharge station (not shown) if necessary. Digital comparator 87 is set, in this embodiment, to provide an output signal when the count from digital counter 81 exceeds the predetermined count from data set switch 88. The output signal from digital comparator 87 is connected to a shift register 89 which acts as a delay for the digital comparator output and provides a delayed output signal to a pulse width control circuit 91, the delay being determined by the amount of time required to shift the output pulse signal through the register in accordance with clock pulses provided by a clock 93. The delay is determined by the amount of time it takes the peach half to travel from viewing line 44 to the discharge station 27. The output pulse provided by control circuit 91 is connected to a solenoid driver 92 which provides a power pulse having the requisite pulse width as determined by the control circuit 91. The power pulse from solenoid driver 92 is connected to solenoid 28 for actuating paddle 29 to thereby discharge the peach half from belt 18. Circuit elements in the schematic block diagram of FIG. 4 are standardized and listed in Table I.

TABLE I

| COMPONENT | ITEM NO. | INDUSTRY DESIGNATION |
|---|---|---|
| Infrared LED's | 42 | ME7121 |

TABLE I-continued

| COMPONENT | ITEM NO. | INDUSTRY DESIGNATION |
|---|---|---|
| Red LED's | 43 | 5082-4658 |
| Multiplexer | 72 | AM3705 |
| Clock | 68 | AD537 |
| Address Counter | 69 | SN7493 |
| Amplifier | 73 | BB3521L |
| One-Shot Circuit | 71 | SN74221 |
| Sample/Hold #1 | 74 | HA2425 |
| Differential Amplifier | 76 | ICL8043 & LF355 |
| Low-Pass Filter | 82 | μA741 |
| Comparator | 83 | LF311 |
| One-Shot Circuit | 84 | SN74221 |
| Sample/Hold #2 | 77 | HA2425 |
| Comparator | 78 | LF311 |
| Counter | 81 | SN74160 |
| Decode/Display | 86 | SN7447/FND507 |
| Digital Comparator | 87 | SN7485 |
| Shift Register | 89 | SN74164 |
| Clock | 93 | NE556 |
| Pulse Width Control | 91 | NE556 |
| Solenoid Driver | 92 | MJE1090 & 2N4126 |

Figure 5:
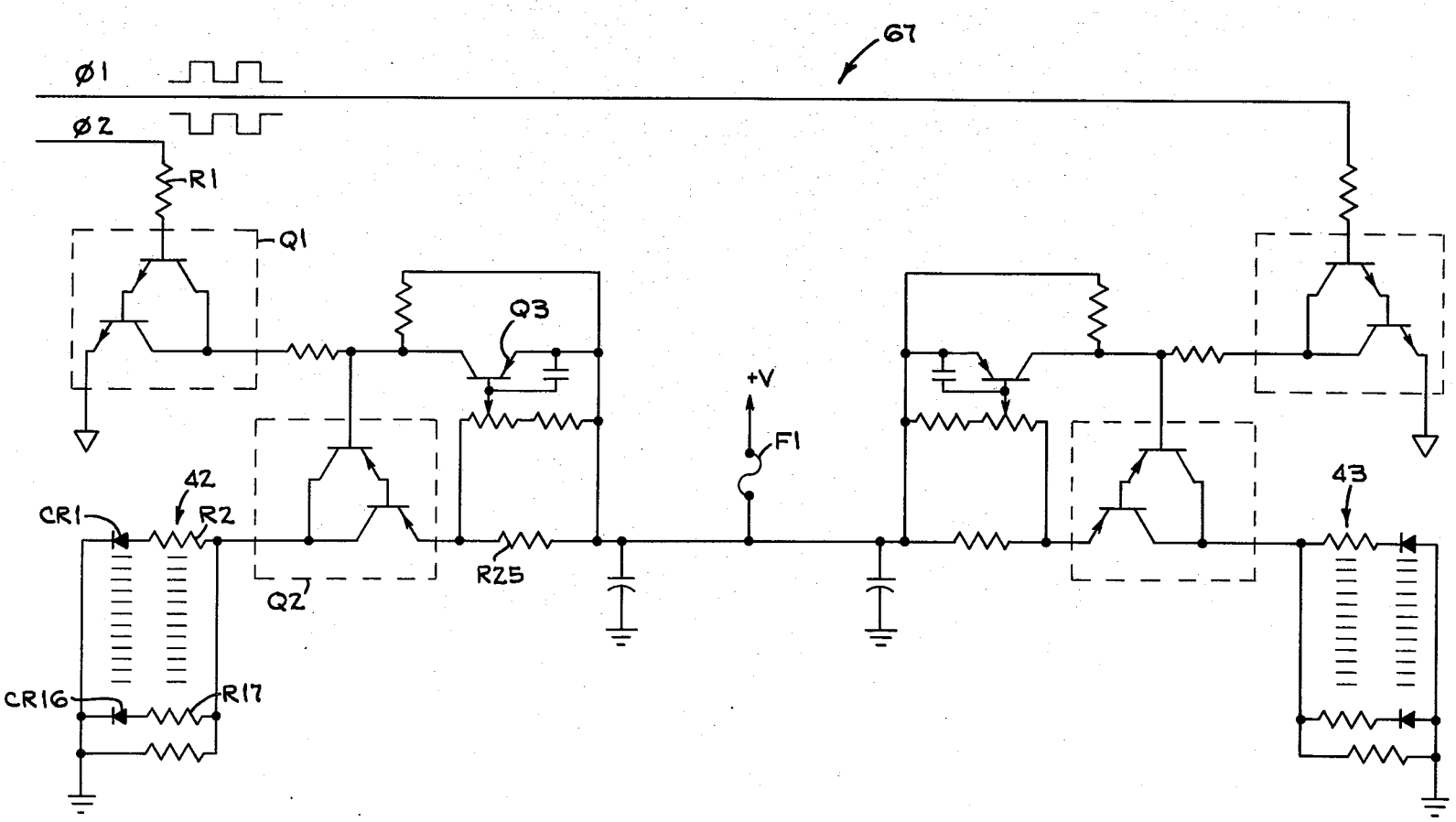
FIG. 5 is an electrical schematic diagram of the light source driver circuits used in the pit fragment detector system.

Referring to FIG. 5 of the drawings, the circuitry for LED driver 67 is shown receiving outputs $\phi_1$ and $\phi_2$ from clock 68 which are 180° out-of-phase. The left half of the circuit of FIG. 5 is used for driving the array of light sources 42, and the right half of the circuit of FIG. 5 is used to drive the array of light sources 43. The two halves of the circuit are identical, operating alternately due to the 180° phase relationship between the actuating clock phase signals $\phi_1$ and $\phi_2$. The left half only of the circuit will be described, it being understood that the right half operates in identical fashion within each clock cycle. Clock signal $\phi_2$ is connected through a resistor R1 to the base of a Darlington preamplifier circuit $Q_1$. When the clock signal $\phi_2$ is high, preamplifier $Q_1$ conducts to drop the voltage level at the base of a power amplifier $Q_2$ and cause the PNP Darlington connection therein to conduct current from the voltage source V through a fuse F1, a current sensing resistor R25, and current limiting resistors R2–R17 to infrared light emitting diodes CR1–CR16 (which comprise the light sources 42). In the event that the voltage source V is inadvertently elevated, one of the current limiting resistors R2–R17 is shorted, or thermal runaway occurs at one of the LED's, a greater voltage drop occurs across current sensing resistor R25 causing transistor $Q_3$ to conduct and raising the signal level at the base of Q2. Q2 being a PNP device therefore conducts less current therethrough to the array of light sources 42. In this fashion the LED's CR1–CR16, are protected from damage due to overcurrent by the shunting of excess current through Q3 around power amplifier Q2.

Figure 6:
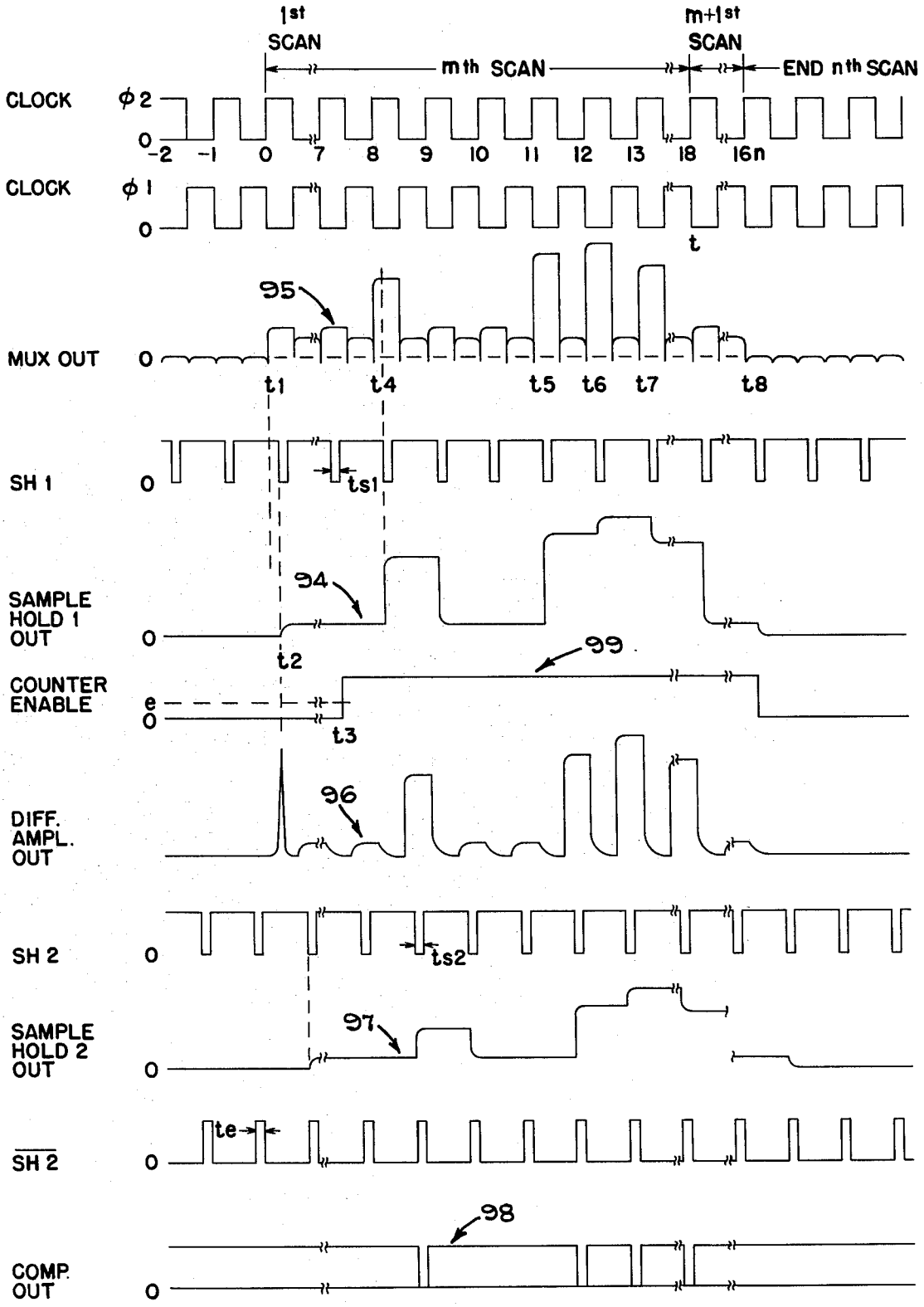
FIG. 6 is a timing diagram for signals in the circuitry of FIG. 4.

FIG. 6 is a timing diagram showing the strobe or clock phase signals $\phi$1 and $\phi$2 which are 180° out-of-phase. Prior to time t1, as indicated in FIG. 6, there is no object at the viewing line 44. At time t1 an object, such as peach half 33, arrives at the viewing line 44. While miltiplexer 72 has been scanning prior to t1, there is no reflected light from viewing line 44 and multiplexer output is zero or a low value as determined by the ambient light conditions. Subsequent to t1, light is reflected from the peach half 33 and the first light sensor in the array 54 produces an output signal 95 due to reflected light transmitted by light source array 42. During the second half of the first clock cycle after t1, the first light sensor in array 54 produces the output signal 95 in accordance with reflected light received from the array of light sources 43. One-shot circuit 71 produces an output SH1 which is of the same frequency as clock signal $\phi$1, but which is shaped and adjusted in phase to provide negative going pulses having a duration indicated as ts1 centered on the first half of each clock cycle while the array of light sources 42 is in the energized mode. This is the sampling window which occurs at time t2 when the amplified output from multiplexer 72 is sampled and provided for the remainder of the clock cycle at the output of sample and hold circuit 74. Sample and hold circuit 74 may be seen in FIG. 6 to begin producing an output represented by curve 94 as soon as a peach half comes into view by the sensors. During the second half of the first clock cycle (after time t1) the array of light sources 42 is turned off and the array of light sources 43 is turned on by clock output $\phi$1. The sampled and held output 94 from circuit 74 is differenced in differential amplifier 76 with the output from multiplexer 72 during the second half of the first clock cycle, and a low output (shown by curve 96) of no consequence is provided, such output not being high enough to produce a signal output from comparator 78. The output from multiplexer 72 during each half cycle is shown in FIG. 6 as being slightly different in level. These outputs may be adjustable by means of appropriately placed trim pots so that they are substantially the same for light reflected from the arrays of light sources 42 and 43 when a fruit section without a pit or pit fragments is coincident with the viewing line 44. Consequently, the output 96 from differential amplifier 76 may be held extremely low when no pit fragments are in the fruit section.

The output 96 from differential amplifier 76 is connected to second sample and hold circuit 77 as described hereinbefore. The output SH2 from one-shot circuit 71, as shown in FIG. 6 provides a train of sample pulses each with a duration indicated as ts2, which pulses are aligned with the difference signals in curve 96 provided during the portion (second half) of each clock cycle that the array of light sources 42 is deenergized. Thus, light sources 42, which transmit light of a wavelength which is more readily reflected by a pit or a pit fragment, are turned off during that portion of each clock cycle when a difference signal is provided which is indicative of the presence of a pit or pit fragment. The sampling pulses SH2 occur at the clock frequency but are adjustable in phase to align them with the center of the second half of each clock cycle. In this manner second sample and hold circuit 77 provides an output signal, shown as curve 97, which is indicative of the difference signal 96 but which does not contain the switching transients seen in the difference signal as produced by differential amplifier 76. The output signal 97 seen from second sample and hold circuit 77 is connected to one input of comparator 78 which has a reference voltage at the other input obtained from trim pot 79. $\overline{\text{SH2}}$ from one-shot circuit 71 is connected to comparator 78 as an enabling signal, thereby providing an output signal from comparator 78, seen as curve 98 in FIG. 6, whenever a difference signal occurs having a level above a predetermined level. The pulses of output signal 98 from the comparator 78 are coupled to digital counter 81, which produces a digital sum of the pulses as hereinbefore described.

It should be noted that the phase of SH1 is adjustable to place the sample signals having duration ts1 in the center of the half-cycle in pulses 95 produced by multiplexer 72 while the array of light sources 42 is energized. It should further be noted that the phase of the output SH2 from one-shot circuit 71 is independently adjustable to place the sample pulse having the dwell time ts2 in the center of the half-cycle in pulses 96 obtained when the array of light sources 42 is deenergized. Consequently, there occurs a differencing of the alternate outputs from the same sensor in the sensor array 54 so that, in this embodiment, differencing occurs sixteen times for each scan of the array of light sensors 54 by multiplexer 72.

FIG. 6 also shows the counter enable pulse 99 which is obtained by passing the signal 94 from sample and hold circuit 74 through the low pass filter 82 and comparator 83. The comparator output is delayed by one-shot circuit 84 until time t3. This delay allows the leading edge of the peach half 33 to pass the viewing line 44. In has been found that spurious signals are generated by reflections from the leading edge of a passing peach half since not all of the sensors in array 54 will receive reflected light from light sources 42 and 43. Also the first sensor to detect the fruit will cause a false signal out of the differential amplifier 76 as shown in FIG. 6. Delaying the enabling of counter 81 prohibits counting of any such spurious signals until after the leading edge of the peach half 33 has passed viewing line 44.

The array 54 of light sensors "looks" at a strip across an object coincident with viewing line 44 which is about one-eighth of an inch wide, in this embodiment, during each scan. The advance rate of the object, such as peach half 33, is usually set by the requirements of the processing line. Therefore, the scanning rate is adjusted to provide an approximate 1/16th inch overlap for each scan by the array of light sensors. Scanning rate is adjusted simply by adjusting the frequency of clock 68.

Figures 7A, 7B, 7C:
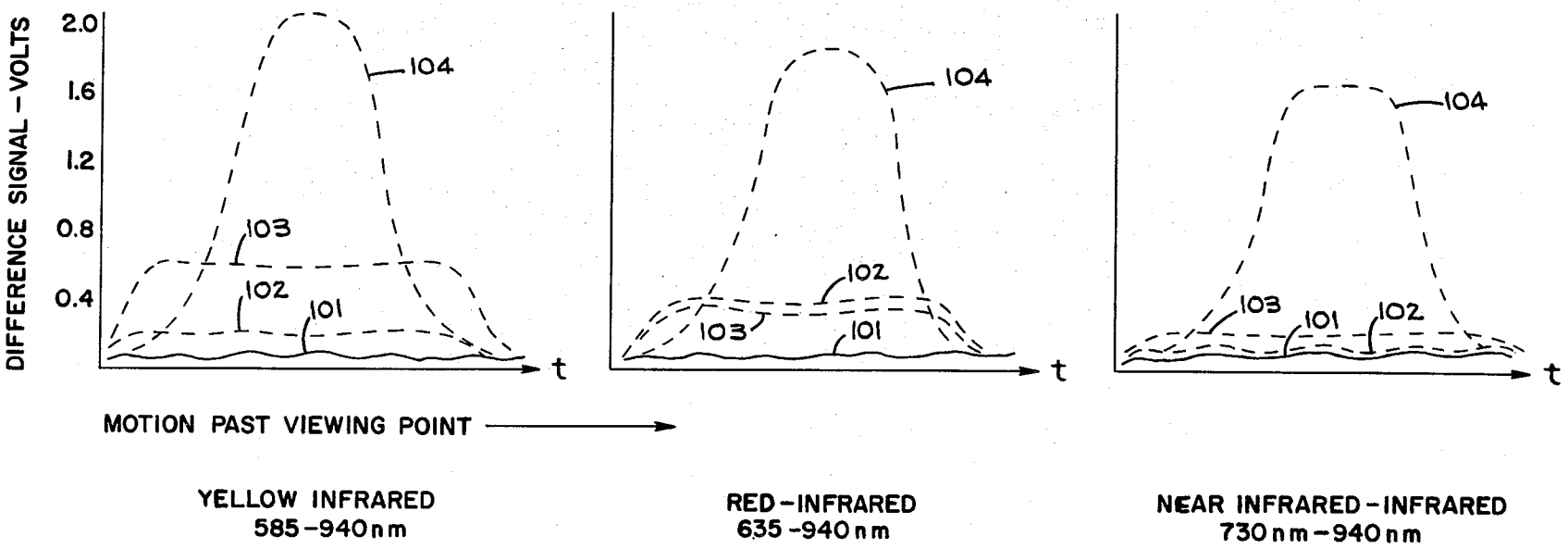
FIG. 7A is a graph showing different signals for different fruit samples using one combination of light source wavelengths.
FIG. 7B is a graph similar to FIG. 7A showing different signals for different fruit samples using another combination of light source wavelengths.
FIG. 7C is a graph similar to FIGS. 7A and 7B showing different signals for different fruit samples using an additional combination of light source wavelengths.

FIGS. 7A, 7B, 7C are graphs showing the difference signal 96 in volts as a sample is moved past the viewing line 44. In FIG. 7A the array of light sources 42 transmits a narrow band with a center wavelength at 940 nanometers. The other array of light sources 43 transmits light at a narrow band of wavelengths with a center wavelength of approximately 585 nanometers. This corresponds to a yellow/infrared light combination. In FIG. 7B the array of light sources 43 is changed to transmit a narrow wavelength band of light having a center wavelength of 635 nanometers. This corresponds to a red/infrared light combination. In FIG. 7C the array of light sources 43 transmits a narrow wavelength band of light with a center wavelength of 730 nanometers. This corresponds to an infrared/near infrared light combination. In FIG. 7A the lower output signal 101 represents the difference signal normalized for a peach half having a clean pit cavity, i.e., wherein the multiplexer outputs due to reflected light from each of the arrays of light sources 42 and 43 are adjusted by means of trim pots to be approximately equal. A difference signal 102 is shown for a peach half having a clean but greenish-hued cavity. A signal 103 is shown for a peach half having a clean but reddish-hued pit cavity. A signal 104 represents a difference signal for a peach half having a pit lodged in the pit cavity. FIGS. 7B and 7C show similar signals having like signal designation numbers for the various types of fruit using the infrared/red and infrared/near infrared light combination respectively. Thus, it can be seen that the comparator 78 can be set at a level to clearly distinguish those peach halves having pits from clean peach halves regardless of the characteristic color of the peach. As seen by comparing the three sets of curves, this is most easily accomplished by using the 730nm/940nm light combination.

It may be seen that a pit and pit fragment detector has been disclosed for fruit sections passing along a processing line which provides 100% inspection of pit cavities in the fruit sections and which provides high resolution for detecting small pit fragments in the cavities.

Although the best mode contemplated for carrying out the present invention has been herein shown and described, it will be apparent that modification and variation may be made without departing from what is regarded to be the subject matter of the invention.

What is claimed is:

1. A detector for spot defects such as fruit pit fragments contained in a fruit which is passed on a path by a viewing line arranged transversely to the direction of movement of the fruit, comprising a first light source providing a first light output directed at the viewing line, a second light source providing a second light output directed at the viewing line and comprised of a different band of wavelengths than said first light output, the relative reflectance of said spot defects and said fruit being distinctly different at said two different light outputs whereby the characteristic color of said spot defect is distinguishable from the fruit color by comparison of the reflectance at said two wavelengths, a clock providing a clock signal in a continuous sequence of clock cycles, means for energizing said first and second light sources during each of said clock cycles, said first light source being energized only during one portion of each of said clock cycles and said second light source being energized during another portion of each of said clock cycles, a plurality of lights sensors disposed in a line extending transversely to the direction in which the fruit passes to receive said first and second light outputs reflected from the viewing line and points proximate thereto, said plurality of light sensors each providing a light sensor output corresponding to intensity of reflected light received in said different bands of light wavelengths, means for scanning said plurality of light sensors and for providing said light sensor output from each of said plurality of light sensors in sequence during successive clock cycles, means for sampling each light sensor output during said portion of each clock cycle in which said first light source is energized, said last named means operating to provide a sample output and to retain said sampled output throughout the remainder of the clock cycle, means for differencing said retained sampled output and said light sensor output, so that when said first light source is deenergized during each clock cycle, a difference signal is provided corresponding to the difference between said sampled and light sensor outputs, said difference signal level being indicative of spot defects at the viewing line.

2. A detector as in claim 1 wherein said second light source is an incandescent lamp and a narrow band light filter.

3. A detector as in claim 1 wherein said first and second light sources are light emitting diodes, and wherein said means for energizing said first and second light sources comprises first and second driver circuits actuated alternately during each clock cycle, each of said first and second driver circuits including a preamplifier receiving said clock signal, a power amplifier having an input driven by said preamplifier and providing an output energizing the associated light source, a current sensing element connected to said power amplifier providing a high current indicative signal, means for feeding back said high current indicative signal to said power amplifier input, said last named means operating to reduce said power amplifier output when said high current indicative signal increases, whereby said light emitting diodes are provided overcurrent protection.

4. A detector as in claim 1 wherein said first light source comprises at least one light emitting diode and said second light source comprises at least one incandescent lamp, and wherein said means for energizing said first light source comprises a first driver circuit including a preamplifier receiving said clock signal, a power amplifier having an input driven by said preamplifier and providing an output energizing said light emitting diode, a current sensing element connected to said power amplifier providing a high current indicative signal, means for feeding back said high current indicative signal to said power amplifier input, said last named means operating to reduce said power amplifier output when said high current indicative signal increases, whereby said light emitting diode is provided with overcurrent protection.

5. A detector as in claim 1 wherein said means for scanning operates at a scan rate sufficient to provide light sensor outputs corresponding to light reflected from overlapping areas on the surface of the fruit in successive scans.

6. A detector as in claim 1 including means for summing said difference signals to determine the size of said spot defect.

7. A detector as in claim 6 wherein said means for summing includes a digital counter providing a digital count output corresponding to the number of difference signals exceeding a predetermined level as the fruit passes by said viewing line, together with a data set switch providing a digital set output, a digital comparator receiving said digital count output at one input and said digital set output at another input, said digital comparator providing a digital comparator output when said digital count output exceeds said digital set output, means for receiving and delaying said digital comparator output and for providing a drive signal, a moving member disposed for motion into and out of the fruit path downstream of the viewing line, and means responsive to said drive signal for actuating said moving member, whereby the fruit is passed on the path or diverted therefrom in accordance with the size of the spot defect.

8. A detector as in claim 6 wherein said means for summing comprises a comparator receiving said difference signals at one input and a reference signal at another input, said comparator being enabled synchronously with said clock signal and providing a pulse output each clock cycle during which said difference signal exceeds said reference signal, and a counter receiving said pulse output and providing a count output.

9. A detector as in claim 8 together with means responsive to said sampled output providing an enabling signal for said counter, whereby said count output is provided only when the fruit is in coincidence with the viewing line.

10. A detector as in claim 8 wherein said counter provides a digital output, together with means for decoding and displaying said count output.

11. A detector as in claim 6 together with means responsive to said sampled output for providing an enabling signal for said means for summing, whereby said difference signals are summed only when the fruit is in coincidence with the viewing line.

12. A detector as in claim 11 wherein said means for providing an enabling signal includes a delay circuit, whereby spurious signals occurring when the leading edge of the fruit is at said viewing line are suppressed.

13. A pit and pit fragment detector for placement on a processing line between a feeding belt and a takeaway belt transporting pitted fruit sections, comprising a housing, a view plate on one end of said housing inclined downwardly at a predetermined angle toward the takeaway belt, first and second light sources mounted in said housing providing first and second light outputs at first and second predetermined wavelengths respectively, said light outputs being directed through said view plate toward a viewing line arranged generally transversely of the direction of travel of said fruit sections, said predetermined wavelengths being selected so that the relative reflectance of said pit and pit fragments and said fruit sections are distinctly different at said two wavelengths whereby the characteristic color of said pit and pit fragments is distinguishable from the color of said fruit sections by comparison of the reflectance at said two wavelengths, a plurality of light sensitive cells mounted in said housing in a line generally transverse to the direction of movement of the fruit section to receive said first and second light outputs reflected from the viewing line and each providing an output signal responsive thereto, a clock providing a clock signal at a clock frequency, means controlled by said clock for energizing said first and second light sources during each cycle of said clock frequency, said first light source being energized only during a part of each clock cycle and said second light source being energized during another part of each clock cycle, a multiplexer having multiple inputs and an output, said multiple inputs being coupled to receive ones of said light sensitive cell outputs, means for addressing each of said multiplexer inputs in succession at said clock frequency, whereby said light sensitive cell outputs are continuously scanned and provided in sequence at said multiplexer output a sample and hold circuit having an input connected to said multiplexer output and providing a sample and hold output, means for enabling said sample and hold circuit at said clock frequency during said part of each clock cycle when said first light source is energized, so that said sample and hold output corresponds to light reflected and received at said first predetermined wavelength and is provided at said sample and hold output for the remainder of each cycle, and a differential amplifier having two inputs and an output, one input receiving said sample and hold output and the other input receiving said multiplexer output, whereby a difference signal is provided at said output during each clock cycle while said first light source is deenergized and a pit or pit fragment is at the viewing line.

14. A pit and pit fragment detector as in claim 13 together with a lens mounted between said plurality of light sensitive cells and the viewing line, said lens operating to focus light reflected from the viewing line onto said light sensitive cells and to shorten image spacing, whereby one dimension of said housing is decreased.

15. A pit and pit fragment detector as in claim 13 wherein said second light source is an incandescent lamp and a narrow band light filter.

16. A pit and pit fragment detector as in claim 13 wherein said second light source has a wavelength spaced in the spectrum removed from the chlorophyll dip, wherein greenish colored fruit does not produce said difference signal.

17. A pit and pit fragment detector as in claim 13 wherein said first and second light sources are light emitting diodes, and wherein said means for energizing said first and second light sources comprises first and second driver circuits actuated alternately during each clock cycle, each of said first and second driver circuits including a preamplifier receiving said clock signal, a power amplifier having an input driven by said preamplifier and providing an output energizing the associated light source, a current sensing element connected to said power amplifier providing a high current indicative signal, means for feeding back said high current indicative signal to said power amplifier input, said last named means operating to reduce said power amplifier output when said high current indicative signal increases, whereby said light emitting diodes are provided overcurrent protection.

18. A pit and pit fragment detector as in claim 13 wherein said first light source comprises at least one light emitting diode and said second light source comprises at least one incandescent lamp, and wherein said means for energizing said first light source comprises a first driver circuit including a preamplifier receiving said clock signal, a power amplifier having an input driven by said preamplifier and providing an output energizing said light emitting diode, a current sensing element connected to said power amplifier providing a high current indicative signal, means for feeding back said high current indicative signal to said power amplifier input, said last named means operating to reduce said power amplifier output when said high current indicative signal increases, whereby said light emitting diode is provided with overcurrent protection.

19. A pit and pit fragment detector as in claim 13 together with means for summing said difference signals to provide an indication of the size of said pit or pit fragment.

20. A pit and pit fragment detector as in claim 19 wherein said means for summing includes a digital counter providing a digital count output corresponding to the number of difference signals exceeding a predetermined level as the pitted fruit section passes said viewing line, together with means providing a digital set output, a digital comparator receiving said digital count output at one input and said digital set output at another input, said digital comparator providing a digital comparator output when said digital count and set inputs are in a predetermined relationship, means for receiving and delaying said digital comparator output and for providing a drive signal, a moving member adjacent the takeaway belt disposed for motion into and out of the fruit section path downstream of the viewing line, and means responsive to said drive signal for actuating said moving member, whereby the fruit section is passed on the takeaway belt or diverted therefrom in accordance with the pit or pit fragment size.

21. A pit and pit fragment detector as in claim 19 wherein said means for summing comprises a comparator receiving said difference signals at one input and a reference signal at another input, said comparator being enabled synchronously with said clock signal and providing a pulse output each clock cycle during which said difference signal exceeds said reference signal, and a counter receiving said pulse output and providing a count output.

22. A pit and pit fragment detector as in claim 19 together with means for providing an enabling signal for said means for summing whereby said difference signals are summed only when the section of fruit is in coincidence with the viewing line.

23. A pit and pit fragment detector as in claim 22 wherein said means for providing an enabling signal includes a delay circuit whereby spurious signals occurring when the leading edge of the fruit section is at said viewing line are suppressed.

24. A method for detecting the presence of a spot defect, such as a pit, pit fragment or the like, in a fruit or fruit section passing a viewing line on a transport path, comprising the steps of directing two separate light spectrum wavelengths toward the viewing line, one of the two wavelengths being more readily reflected by said spot defect than the other, cycling at least one of the two wavelengths on and off at a predetermined frequency whereby it is on only for a portion of each cycle, sensing the reflections of the two wavelengths from the fruit or fruit section at said viewing line and providing an output corresponding thereto, sampling the sensed output during the portion of each cycle the said one wavelength is on and holding the sample during the remainder of the cycle, differencing the sampled and held sensed output with the sensed output during each cycle when said one wavelength is off and the other wavelength is on, and summing the differences which exceed a predetermined difference whereby the size of a pit or pit fragment is indicated.

* * * * *